United States Patent [19]

Aitken et al.

[11] 4,106,902

[45] Aug. 15, 1978

[54] AMMONIA TREATMENT OF TEXTILE MATERIALS

[75] Inventors: John Aitken; William Eric Graham, both of Paisley, Scotland

[73] Assignee: J. & P. Coats Limited, Glasgow, Scotland

[21] Appl. No.: 628,319

[22] Filed: Nov. 3, 1975

[30] Foreign Application Priority Data

Nov. 7, 1974 [GB] United Kingdom ..... 48129/74

[51] Int. Cl.[2] ..... D06M 1/08

[52] U.S. Cl. ..... 8/181; 8/125; 8/127

[58] Field of Search ..... 8/181, 125, 127

[56] References Cited

U.S. PATENT DOCUMENTS

| | | | |
|---|---|---|---|
| 2,549,713 | 4/1951 | Seiberlich | 260/212 |
| 3,767,359 | 10/1973 | Calamari et al. | 8/115.7 |

FOREIGN PATENT DOCUMENTS

| | | | |
|---|---|---|---|
| 1,133,899 | 11/1968 | United Kingdom | 8/125 |

*Primary Examiner*—John Kight, III

*Attorney, Agent, or Firm*—Larson, Taylor and Hinds

[57] ABSTRACT

A process of treating textile material of a cellulosic nature with ammonia includes the step of first applying water to the textile material before the material is impregnated with ammonia. The amount of water applied must be enough to raise the moisture content of the material to a level above that normally present in the prevailing conditions of atmospheric humidity but with a maximum value of 30% by weight of the dry material.

4 Claims, 1 Drawing Figure

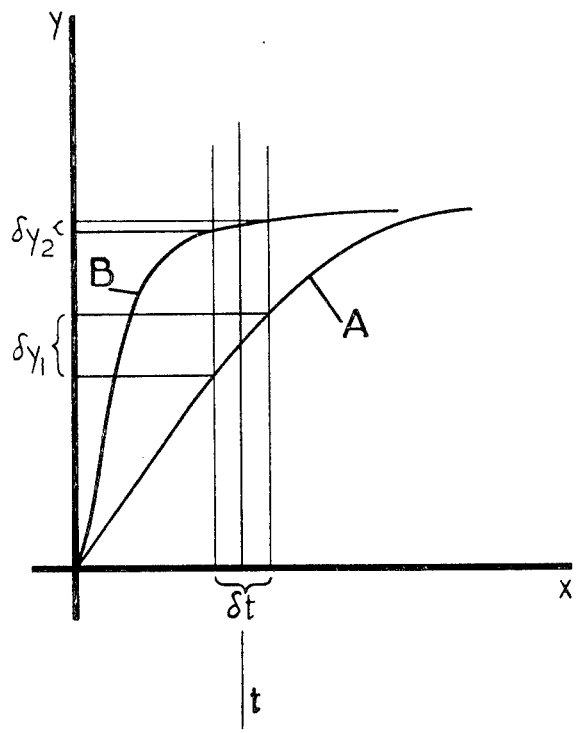
y
$\delta y_2$
B
A
$\delta y_1$
x
$\delta t$
t

AMMONIA TREATMENT OF TEXTILE MATERIALS

This invention relates to treatment of textile materials of a cellulosic nature, e.g. cotton, by liquid ammonia to alter or enhance certain properties of the materials.

Textile materials are frequently treated with liquid ammonia for the purpose of changing or improving the characteristics of the materials, for example, treatment of textile materials with liquid ammonia under appropriate conditions can produce any or several or all of the following characteristics:-improved bulk, improved lustre, high strength, reduced extensibility, increased affinity for dyes of certain types and enhanced evenness of dye take up.

When liquid ammonia is applied to textile fibres the desirable effects are caused or at least set in motion by the swelling action produced on the fibres by the ammonia. The stage which the reaction between the fibres and the ammonia reaches is determined by the time of contact. There is, however, a practical limit to the length of time during which the ammonia can be left in contact with the fibres otherwise the treatment would take too long and would be uneconomic. It has been found that the progressive degree of change effected in textile fibres by ammonia does not vary linearly over constant successive increments of time. The effect increases at a rapid rate initially and then the rate of change declines and becomes progressively smaller as time goes on. A curve showing change plotted against time rises steeply from the origin and then turns abruptly and continues at a rising but much less steep rate. Because of this non-linear effect it has been found possible to treat materials with ammonia and stop the treatment before the full effect has been obtained. This reduces the time of treatment appreciably while still effecting a useful proportion of the total change possible in the material. One effect of this incomplete change is found in material subsequently dyed after the ammonia treatment. Because of the incomplete and somewhat uncontrolled degree of change the level of dyeing varies widely even in a continuous treatment process. The reason is that the treatment is performed entirely on the part of the curve of change against time where the gradient of the curve is steep. On this part of the curve a small change in the time produces comparatively larger differences in the amount of change effected in the fibres. In the short time available for treatment with ammonia in the practical process, usually less than one second, it is extremely difficult to maintain the time of treatment exactly constant because of variation in the time of penetration of the ammonia. It would thus be of great advantage in promoting evenness of characteristics if the ammonia process could be continued on to and completed on the portion of the curve which is much less steep because in this position quite large variations in time produce only small changes in the characteristics of the material. Also since the ammonia treatment has been carried further the changes produced by the ammonia in the material are enhanced, for example dye take up is improved. Heretofore to continue the treatment process on to the portion of the curve where the gradient is small has required a time of treatment disproportionately long and in fact too great for economic reasons. It is an object of the invention to accelerate the effect produced by the application of ammonia so that the effect of the ammonia on a particular material in a given time is greater than has been possible heretofore, preferably by continuing the ammonia action on to the small gradient portion of the curve in a time short enough to be economic.

A process of treating textile material with ammonia according to the invention incorporates prior to the ammonia treatment step the step of applying water to the textile material to be treated so that the moisture content of the material to be treated with ammonia is greater than the moisture content normally present in the prevailing conditions of atmospheric humidity but with a maximum value of 30% by weight of the dry material.

The water may be applied in metered quantities so that the moisture content of the material is maintained accurately at or close to a predetermined figure.

Where the material being treated is a textile yarn the yarn may be led over a roller dipping into a reservoir of water, the roller being rotated and the rate of rotation being variable so that the quantity of water brought into contact with the yarn is variable. Alternatively the yarn may be run through a guide into which water is fed at an accurately controlled rate.

The invention makes use of a surprising effect found by the applicants. It has long been known to dilute an ammonia bath with water in fact liquid ammonia tends strongly to take up water but it has been found that when an ammonia bath is diluted with water the action of the ammonia on the material passing through the bath is decelerated so that the effect is actually the opposite of what is desired. For that reason up till now the endeavour has been to eliminate from an ammonia bath or keep as low as possible the quantity of water in an ammonia bath and as an extension of that idea to limit the quantity of water in the material to be treated. The inventors of the present invention have surprisingly found that the pre-treatment of textile material with water, far from introducing a dilution effect on the ammonia actually increases the rate of effect of ammonia on the material. While the process is not fully understood it is believed that the water causes an initial swelling of the textile material thus increasing its accessibility to the ammonia, in effect a larger quantity of ammonia is acting on the same weight of material than when dry material is brought into contact with the ammonia. The effect of bringing a material already containing water into liquid ammonia is thus different from bringing the same material in a dry state into ammonia containing water. The distinction is small but very important, the water acting to increase the available surface area of a given weight of textile material thus increasing the number of ammonia molecules able to react with the material whereas in the ordinary process water present in ammonia merely dilutes and in fact reduces the number of ammonia molecules which can react with the given quantity of textile material.

The present invention has been found to be of great use with the process which is the subject of our prior U.S. Pat. No. 3,560,140. It has been found that all the desirable characteristics which are obtained by the process of the said prior patent are enhanced and particularly the evenness of dye take up of material treated by that process.

In practice, it has been found that in the treatment of textile materials by liquid ammonia and using the present invention considerable improvements have been effected in the affinity for dyes of certain types. The increased affinity for dyes has been found to be accompanied by a greatly enhanced evenness of dye take up. This gives a doubly good effect in that not only is the dyeing process reduced in time but dye exhaustion is increased and the enhanced evenness of dye take up provides a constancy of shade which has not so far been obtainable over a large throughput of material being dyed. Where the invention is operated to cause the ammonia process to be continued on to the small gradient portion of the curve referred to small changes in the time during which the material is subjected to the ammonia provides such small changes in the effect produced by the variation in the time of application of ammonia that it either has no effect on the dye action or the change in effect is too small to be detected by the unaided eye. In addition to these advantages the lustre is found to be further improved and where one of the objects of the ammonia treatment is to increase the strength of the material the increase has been found to be greater than it is without the use of the invention.

The advantages obtained by the process of the invention are clearly shown in the accompanying graph and in the table below.

In the graph the x-axis represents time of subjection of the yarn to ammonia, the y-axis represents the magnitude of the swelling action taking place on a given yarn, the curve A represents the effect of ammonia on the given dry yarn plotted against time of treatment with ammonia and the curve B represents the effect of ammonia on the same yarn after the yarn has been impregnated with a quantity of water according to the process of the invention. The time $t$ is the normal treatment time found to be economic for treating the given yarn and the time $\delta t$ is the small variation in treatment time which normally occurs in operation of the ammonia treatment process and which cannot be reduced or eliminated without the use of very expensive controls. $\delta y_1$ is the variation of effect on the yarn resulting from a treatment time variation of $\delta t$ when operating on the curve A, i.e. with dry yarn impregnated with ammonia only and $\delta y_2$ is the variation of effect on the yarn resulting from the same treatment time variation $\delta t$ when operating on the curve B, i.e. with the yarn impregnated with a quantity of water according to the process of the invention. The advantage of the process of the invention is clearly shown by comparing $\delta y_1$ and $\delta y_2$. It is obvious that the variation in the effect on yarn impregnated with a quantity of water according to the invention is much less for a given time variation $\delta t$ than it is on yarn not treated by the process of the invention for the same time variation $\delta t$.

The expressions "dry material" and "dry yarn" as used above, in the table and in the claim mean completely dry material and yarn from which the water naturally present in the prevailing conditions of atmospheric humidity has been removed. Also, $\delta y_2$ is further up the y-axis than $\delta y_1$ indicating that the effect of the ammonia on the previously water-impregnated yarn had been greater in the given time $t$ than it has been on the previously dry yarn. This partly accounts for the greater tensile strength and other characteristics obtained by the process of the invention.

The effect on tensile strength and dye take up after ammonia treatment of a particular yarn are shown in the table below.

| Yarn — 185 dtex (32 Ne) × 2 | | a value (inverse of depth of shade for a given dye bath strength |
|---|---|---|
| % water added | tensile strength (g) | |
| 0.0 (dry yarn) | 814 | 13.37 |
| 14.4 | 840 | 12.84 |
| 20.7 | 894 | 12.87 |

The expression "textile material" and "yarn" as used in this specification includes threads, yarns, woven and non-woven material, knitted material and other dispositions of textile fibres in web form.

What is claimed is:

1. A process of treating textile material of a cellulosic nature with liquid ammonia including the step of first applying water to the textile material which is to be subsequently impregnated with liquid ammonia so that the mositure content of the material before impregnation with liquid ammonia is greater than the mositure content normally present in the prevailing conditions of atmospheric humidity but with a maximum value of 30% by weight of the dry material and then impregnating the water-containing textile material with liquid ammonia.

2. A process according to claim 1 wherein the textile material is selected from the group consisting of yarn, woven material, and knitted material.

3. A process according to claim 2 wherein the textile material is impregnated with said liquid ammonia while in an unstretched condition.

4. A process according to claim 1 wherein said textile material is impregnated by treatment with said liquid ammonia for less than one second.

* * * * *